US011344787B2

(12) United States Patent
Vito

(10) Patent No.: US 11,344,787 B2
(45) Date of Patent: May 31, 2022

(54) ATHLETIC PROTECTOR

(71) Applicant: Matscitechno Licensing Company, Kennett Square, PA (US)

(72) Inventor: Robert A. Vito, Kennett Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 0 days.

(21) Appl. No.: 16/189,218

(22) Filed: Nov. 13, 2018

(65) Prior Publication Data

US 2019/0344151 A1 Nov. 14, 2019

Related U.S. Application Data

(60) Provisional application No. 62/671,079, filed on May 14, 2018.

(51) Int. Cl.
*A63B 71/12* (2006.01)

(52) U.S. Cl.
CPC ..... *A63B 71/1216* (2013.01)

(58) Field of Classification Search
CPC ..... A63B 71/1216; A63B 71/12; A41D 13/015; A41D 13/0525; A41D 13/05; A41D 31/285
USPC .... 2/466, 455, 156, 159, 170, 218, 401, 403
See application file for complete search history.

(56) References Cited

U.S. PATENT DOCUMENTS 3,909,847 A * 10/1975 Holt ..... A41D 1/088 2/465
4,198,708 A * 4/1980 Fugere ..... A41D 13/0568 2/16
5,174,307 A 12/1992 Thompson
6,093,468 A * 7/2000 Toms ..... A41D 13/0506 428/67
8,752,217 B1 * 6/2014 Cheney ..... A41D 13/0525 128/846
2004/0024341 A1 * 2/2004 Jacobs ..... A63B 71/1216 602/72
2005/0039245 A1 * 2/2005 Landi ..... A41D 13/05 2/455
2005/0210570 A1 * 9/2005 Garneau ..... A41D 13/0537 2/466
2015/0107005 A1 * 4/2015 Schneider ..... A63C 17/0046 2/414
2015/0157066 A1 * 6/2015 Huang ..... A41D 13/0156 2/455

(Continued)

FOREIGN PATENT DOCUMENTS

FR 1003779 A 3/1952
WO 2012021737 A1 2/2012
WO 2018064406 A1 4/2018

OTHER PUBLICATIONS

English machine translation of FR 1,003,779 A. via espacenet.com. Translation performed May 6, 2020. (Year: 1952).*

(Continued)

*Primary Examiner* — Jameson D Collier
(74) *Attorney, Agent, or Firm* — RatnerPrestia

(57) ABSTRACT

An athletic protector is provided having a pad formed from a plurality of layers and configured to be impact-resistant. The pad has a central portion which is delineated along a perimeter thereof by an edge portion. The edge portion extends from the perimeter of the central portion to an outer perimeter and has a thickness that is less than a thickness of the central portion of the pad.

10 Claims, 9 Drawing Sheets

(56) References Cited

U.S. PATENT DOCUMENTS

| | | | | |
|---|---|---|---|---|
| 2016/0332711 | A1* | 11/2016 | Harrington | A41D 13/0005 |
| 2016/0339323 | A1* | 11/2016 | Vito | B32B 25/08 |
| 2017/0340039 | A1* | 11/2017 | Jur | A41D 13/08 |
| 2018/0132547 | A1* | 5/2018 | Vito | A41D 13/0518 |

OTHER PUBLICATIONS

Extended European Search Report for European Application No. 19172885.6, dated Sep. 20, 2019, 10 pages.

* cited by examiner

ATHLETIC PROTECTOR

INCORPORATION OF PROVISIONAL APPLICATION

This is a non-provisional application, which claims priority to U.S. provisional patent application No. 62/671,079, filed May 14, 2018, the disclosure of which is incorporated herein by reference in its entirety for all purposes.

FIELD OF THE INVENTION

The invention relates generally to the field of protective apparatuses, and more particularly to athletic protectors.

BACKGROUND OF THE INVENTION

Athletes are often involved in activities that include bodily contact or a likelihood that certain areas of the athlete's body will be subjected to heavy physical blows. As a result of the male anatomy, male athletes are particular susceptible to impacts to the male genitalia or the region surrounding thereof. This can present a substantial problem for the male athletes as blows to the male genitals can result in incapacitating pain and produce irreparable damage.

The most common form of protection for a male athlete is an athletic cup having a concave receptacle that generally surrounds the male's genitals. Such devices are generally formed of a hard plastic and are designed to be rigid to protect the male athlete's genitals. However, athletes may suffer discomfort or chafing while performing athletic activities wearing such rigid materials.

Accordingly, there is a need for improved athletic protectors for protecting an individual's genitalia or other sensitive areas.

SUMMARY OF THE INVENTION

Aspects of the invention are directed to protective apparatuses, and more particularly to athletic protectors. In accordance with one aspect, an athletic protector is provided having a pad formed from a plurality of layers and configured to be impact-resistant. The pad has a central portion which is delineated along a perimeter thereof by an edge portion. The edge portion extends from the perimeter of the central portion to an outer perimeter and has a thickness that is less than a thickness of the central portion of the pad.

BRIEF DESCRIPTION OF THE DRAWINGS

The invention is best understood from the following detailed description when read in connection with the accompanying drawings, with like elements having the same reference numerals. When a plurality of similar elements are present, a single reference numeral, may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

Aspects of the invention relate to protective apparatuses, and more particularly to athletic protectors. The inventor recognized that conventional athletic cups, which include a rigid shell forming a receptacle for receiving a male's genitals, presents numerous drawbacks that are difficult to overcome due to the fundamental design of such athletic cups. For instance, during athletic activities, the athletic cup may be jostled such that portions of the male genitalia are repositioned outside of the receptacle of the athletic cup. This type of event often leads to injury of the male as the edge of the athletic cup may pinch portions of the male genitalia positioned outside of the receptacle or can lead to such portions of the male genitalia being squeezed between the outside surface of the rigid athletic cup and the athlete's leg. Thus, the rigid shell, which provides the protective attributes of the athletic cup, creates a substantial risk of injury to the athlete. Such risks often lead to athletes deciding not to wear an athletic cup.

The athletic protectors disclosed herein are configured to provide improved protection against the force of impacts while avoiding many of the problems associated with typical athletic cups. Embodiments of the athletic protectors are well suited to be employed as a sole source of protection for athletes, or used in combination with other protective pads and/or layering. For example, the athletic protector may be formed without a rigid shell. The athletic protectors may generally be employed under protective gear, clothing, or devices where impact-resistance is desired. The athletic protectors may be formed to have a flat or curved or bended structure, which may be sufficiently flexible to allow contouring to the athlete's anatomy when worn within or beneath a garment or other piece of equipment. The athletic protectors may be sufficiently flexible to allow molding into a desired shape or angle, while be sufficiently rigid to hold a desired shape or angle after being molded by the user.

Although embodiments of the invention are discussed herein with respect to athletes, it should be understood that aspects of the invention are well suited for use with law enforcement agencies, military personal, security guards, and the like. For example, embodiments of the invention may be particularly suited for law enforcement agencies, as police officers are often required to sit long hours in a vehicle and the superior flexibility of aspects of the invention may provide improved comfort for such law enforcement personnel.

Figure 1:
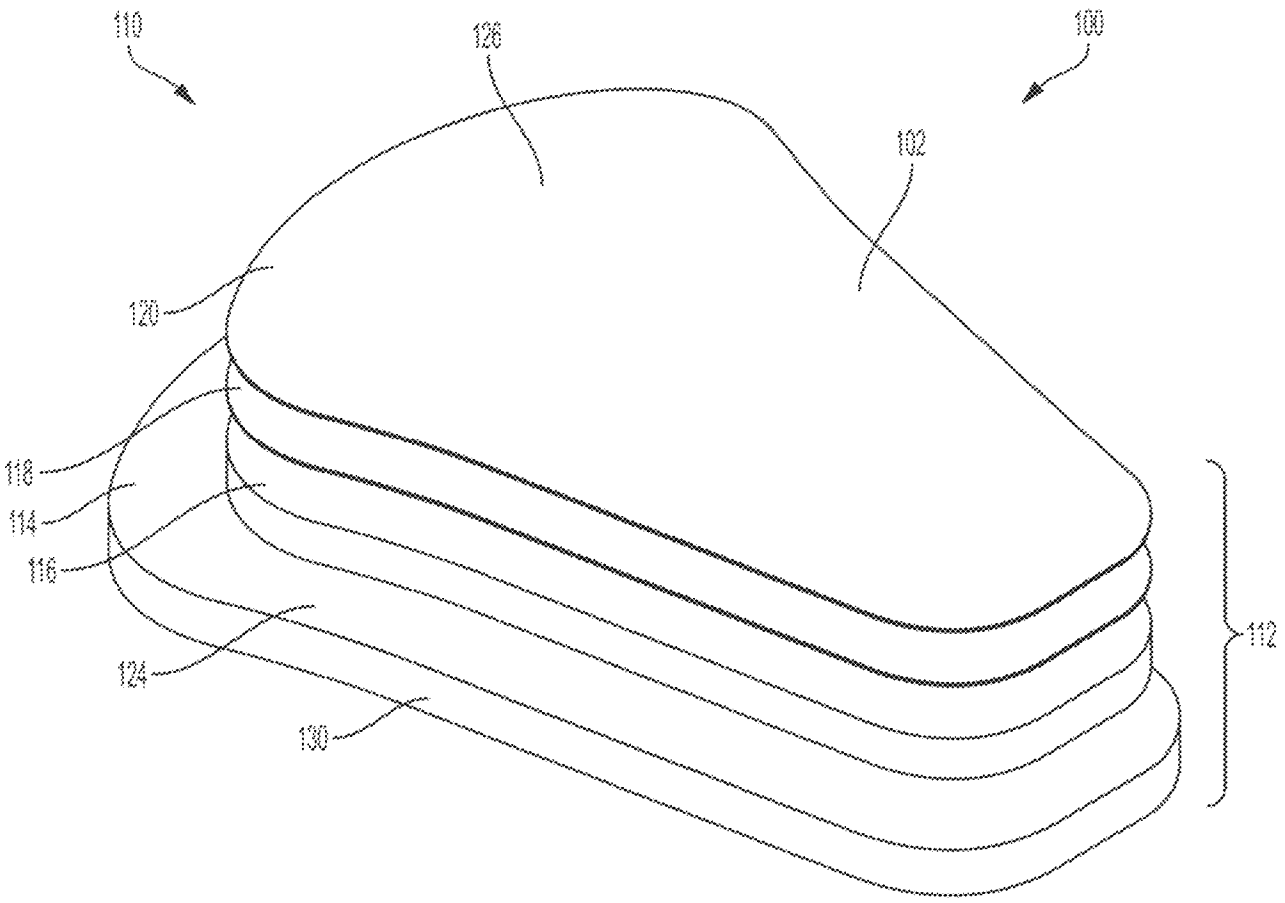
FIG. 1 is a schematic of an exemplary athletic protector in accordance with aspects of the invention.

FIG. 1 is a schematic illustrating an exemplary athletic protector 100 according to aspects of the invention. As a general overview, athletic protector 100 includes a pad 110 formed from a plurality of layers 112 and configured to be impact-resistant. As used herein, the term "impact-resistant" is intended to encompass any object or material that partially or fully lessens, diminishes, dissipates, deflects, or absorbs the mechanical force of an impact.

Pad 110 is formed from a plurality of layers 112. The plurality of layers 112 may be coupled to each other directly, e.g., by way of adhesives or mechanical attachment, or indirectly, e.g., by way of an additional layer of adhesive material. The plurality of layers 112 may include one or more elastomer layers, such as first elastomer layer 114 and second elastomer layer 116. Second elastomer layer 116 may be formed from the same elastomer materials or from different materials as first elastomer layer 114. Although pad 100 is illustrated in FIG. 1 as having a first elastomer layer 114 and a second elastomer layer 116, pad 110 may be formed to have less than two elastomer layers (i.e. one elastomer layer) or more than two elastomer layers (e.g., at least 3 elastomer layers, at least 4 elastomer layers, at least 5 elastomer layers, etc.).

The elastomer materials, and layers formed therefrom, may provide impact-resistance by absorbing and/or dissipating the forces of impacts along the surface of the elastomeric material. Suitable elastomer materials for forming elastomer layers 114 and/or 116 include, but are not limited to, urethane rubbers, silicone rubbers, nitrile rubbers, butyl rubbers, acrylic rubbers, natural rubbers, styrene-butadiene rubbers, combinations thereof, and the like. Suitable materials and layers for use as layers 112, and/or for use in forming pad 110, are described in U.S. patent application Ser. No. 15/578,961, entitled "IMPACT-RESISTANT MATERIAL AND PAD," filed Dec. 1, 2017, the contents of which are incorporated herein by reference. Other suitable elastomers will be known to one of ordinary skill in the art from the description herein.

Preferably, first elastomer layer 114 has a density sufficiently low to enable it to mold to a shape of the athlete's genitalia when pad 110 is worn and/or pressed against the athlete. Such molding may desirably increase the comfort and stability of pad 110 during use. The first density is preferably low enough to provide comfort and contouring, to the athlete, while high enough to provide some rigidity and dissipation of the force of impacts. For example, first elastomer layer 114 has a density of at least 6 lbs. per cubic foot and/or a density of 29 lbs. per cubic foot or less. In one embodiment, first elastomer layer 114 has a density of 9 lbs. or about 9 lbs. per cubic foot. In an exemplary embodiment, first elastomer layer comprises a layer of closed cell, low density soft elastomeric foam. The first elastomer layer 114 may comprise a layer of AIRILON® padding material, provided by Unequal Technologies Company, of Glen Mills, Pa., USA.

The plurality of layers 112 may also include one or more high-tensile strength layers 118 formed of or comprising high-tensile strength materials. High-tensile strength layer 118 may be configured to dissipate the energy of an impact along the length of the fibers, thus spreading out the force along the entire surface of pad 110. Suitable high-tensile strength fibrous materials for high-tensile strength layer 118 include, e.g., aramid fibers, para-aramid or synthetic fibers, fiberglass, or other high-tensile strength fibers. Other suitable high-tensile strength fiber materials will be known to one of ordinary skill in the art from the description herein.

The high-tensile strength, layer 118 may be coated with one or more substances. For example, the high-tensile strength layer 118 may be coated with a polymer material. The polymer material may be the same as or different from the polymer material of polymer layer 120, which is further discussed below. In one embodiment, the polymer material coating high-tensile strength layer 118 is part of polymer layer 120. In an alternative embodiment, the polymer material coating high-tensile strength layer 118 is distinct and/or separate from polymer layer 120. In a preferred embodiment, high-tensile strength layer 118 comprises a TRIDUR® padding material, provided by Unequal Technologies Company, of Glen Mills, Pa., USA. Alternatively, high-tensile strength layer 118 may include the fibers formed from KEVLAR material, provided by E.I. du Pont de Nemours and Company, of Wilmington, Del., USA.

As illustrated by FIG. 1, the plurality of layers may include a polymer layer 120. Polymer layer 120 may be formed from natural or synthetic polymers, such as polypropylene, polyethylene, polystyrene, polyvinyl chloride, nylon, etc. In a preferred embodiment, polymer layer 120 comprises a layer of IMPACSHIELD® padding material, provided by Unequal Technologies Company, of Glen Mills, Pa., USA. Other suitable polymers will be known to one of ordinary skill in the art from the description herein. Although pad 110 is illustrated in FIG. 1 as having polymer layer 120, other embodiments of athletic protector 100 may include a pad that does not have a polymer layer.

The plurality of layers 112 may be arranged to provide superior impact-resistance for the wearer of athletic protector 100. For example, plurality of layers 112 may be arranged such that first elastomer layer 114 and second elastomer layer 116 are more proximal to the athlete relative to high-tensile strength layer 118 and/or polymer layer 120 during use/application of athletic protector 100. In the embodiment illustrated in FIG. 1, the plurality of layers 112 is configured such that polymer layer 120 comprises a polypropylene polymer that blocks and redirects impacts; the high-tensile strength layer 118 absorbs and disperses vibrational energy associated with the impact across the aramid fibers; the second elastomer layer 116 comprises a closed cell, high density elastomer foam that absorbs impact energy; and a first elastomer layer 114 comprises a closed cell low density, soft elastomer foam.

Pad 110 is configured to provide improved comfort and flexibility in addition to the above-mentioned improved impact-resistance. Pad 110 is delineated by an outer perimeter 130 that defines an edge portion 124 extending by a width $W_1$ from the outer perimeter 130 to a perimeter 127 delineating central portion 126 of pad 110. For example, width $W_1$ of edge portion 124 may range from $3/8^{th}$ inch to $7/8^{th}$ inch for an adult male and range from $1/4^{th}$ inch to $5/8^{th}$ inch for an adolescent male athlete. Alternatively, width $W_1$ of edge portion 124 may range from $3/8^{th}$ inch to $5/8^{th}$ inch for an adult female and range from $1/4^{th}$ inch to $1/2^{th}$ inch for an adolescent female athlete. In one embodiment, edge portion 124 extends by a width $W_1$ from outer perimeter 130 to perimeter 127 of central portion 126 by $5/8^{th}$ inch or by about $5/8^{th}$ inch. The dimensions of edge portion 124 may be configured to be modified or selected to fit athletes of various sizes and genders. In the embodiment illustrated in FIG. 1, width $W_1$ of edge portion 124 is formed from the difference in the width across central portion 126 and the width across elastomer layer 114.

Figure 2A:
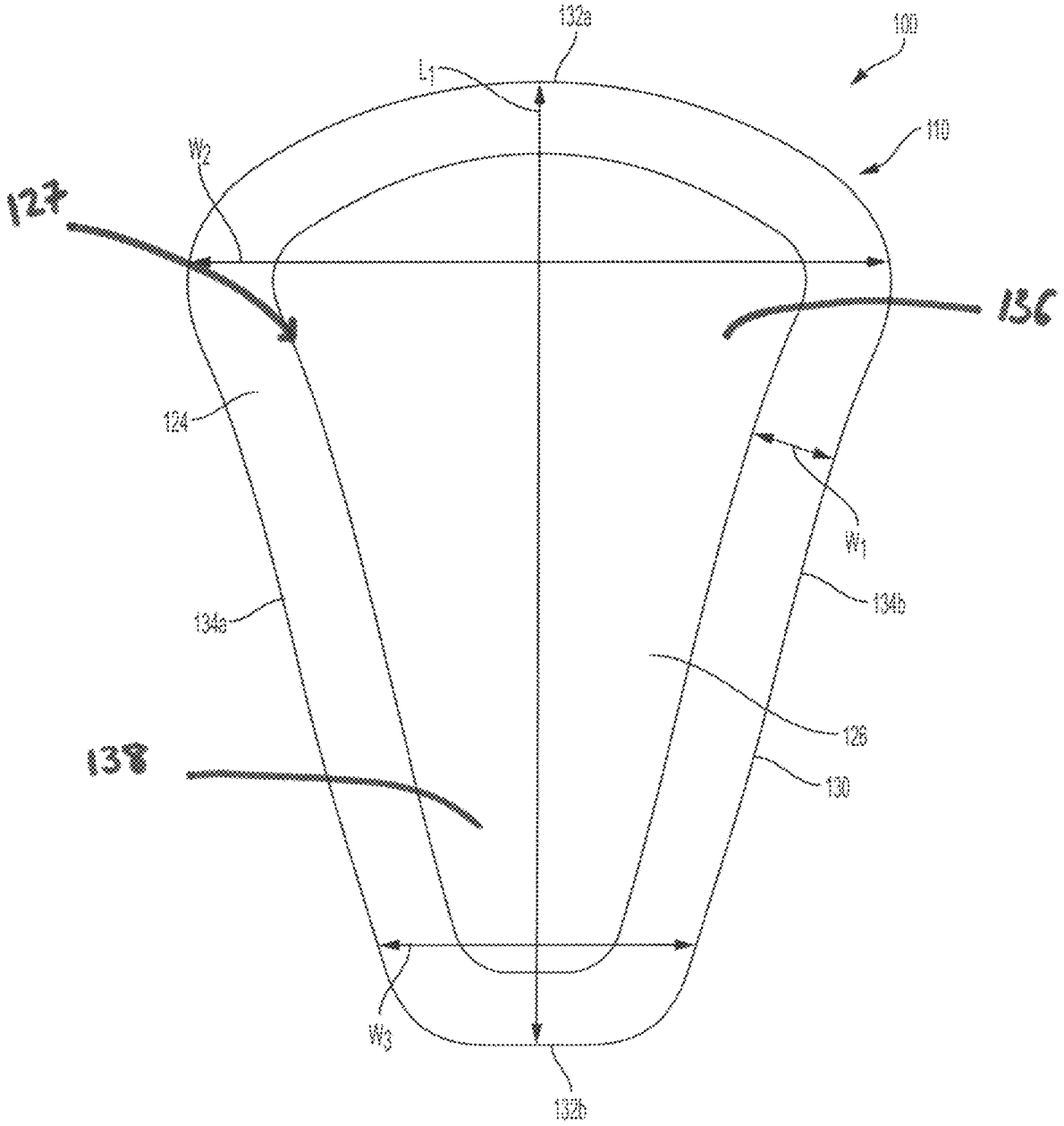
FIG. 2A is an elevation view another exemplary athletic protector in accordance with aspects of the invention.
Figure 4A:
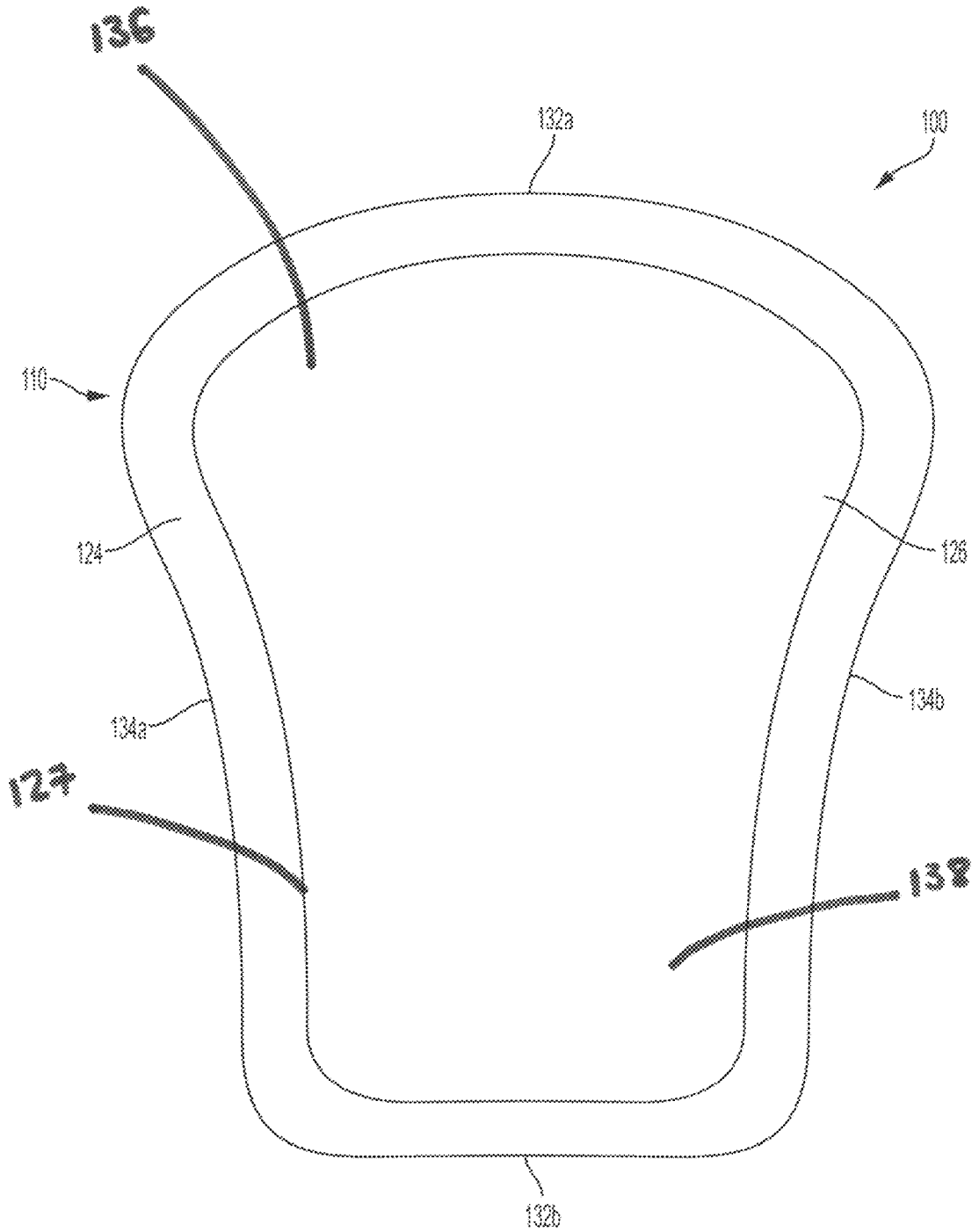
FIG. 4A is an elevation view of yet another exemplary athletic protector iii accordance with aspects of the invention.
Figure 4B:
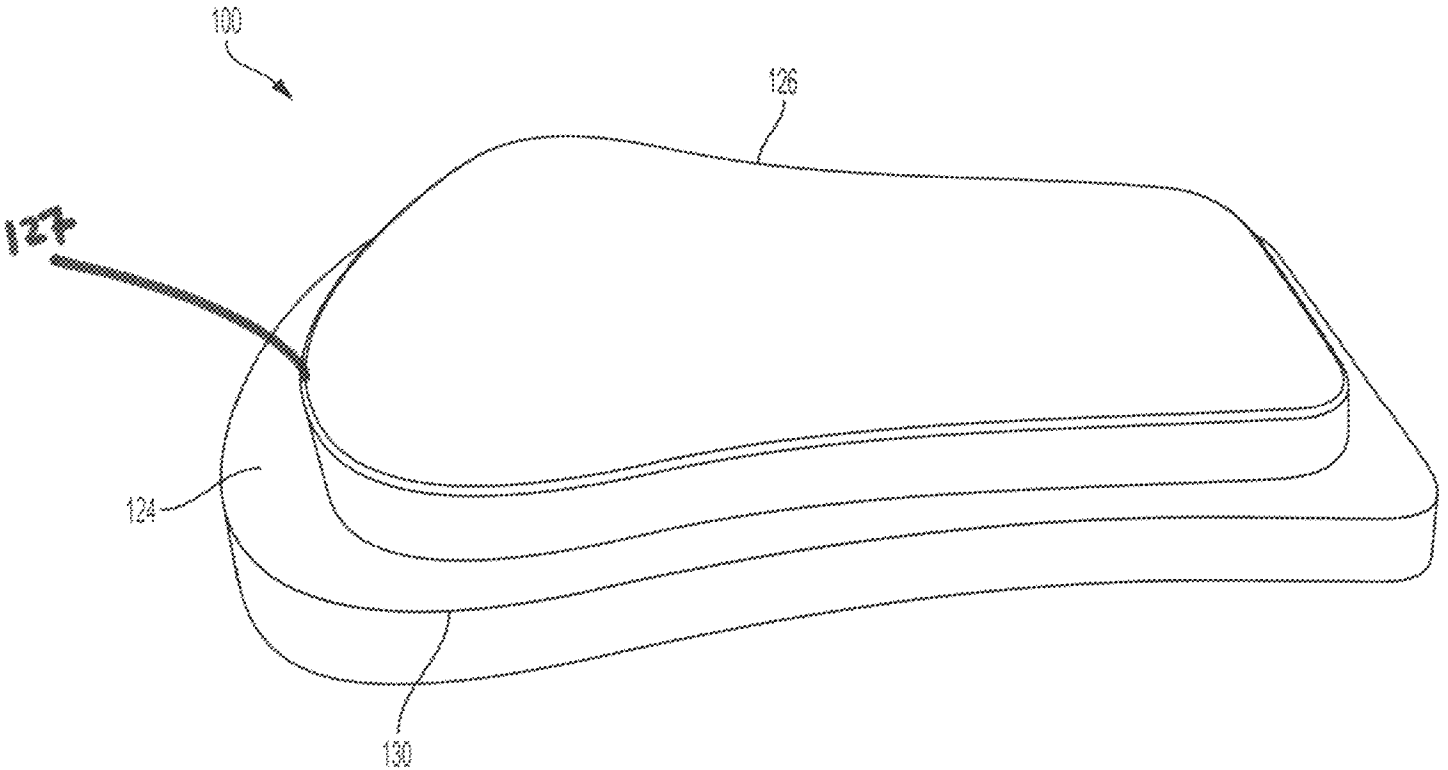
FIG. 4B is a perspective view of the athletic protector of FIG. 4A.

Outer perimeter 130 of pad 110 is defined by a first side 132*a* spaced from a second side 132*b* by a length $L_1$ and a third side 134*a* spaced from a fourth side 134*b* at a top portion of pad 110 by a top width $W_2$ and at a bottom portion of the pad 110 by a bottom width $W_3$. First side 132*a* is, preferably, spaced from second side 132*b* by a length $L_1$ such that pad 110 extends to cover and/or protect an area above the athlete's genitalia to an area below the athlete's genitalia. In one embodiment, length $L_1$ of pad 110 is 6 inches or more and 10 inches or less. In another embodiment, length $L_1$ of pad 110 is 7.5 inches or about 7.5 inches. The top width $W_2$ of pad 110 may be greater than bottom width $W_3$ of pad 110, e.g., by a ratio of 1.5:1 to 3.5:1. For example, the ratio of top width V of pad 110 to bottom width $W_3$ of pad 110 may be 2:1 or about 2:1. In one embodiment, pad 110 has a top width $W_2$ ranging from 3.5 inches to 7.5 inches and a bottom width $W_3$ ranging from 0.25 inches to 4.25 inches. In a preferred embodiment, pad 110 has a top width $W_2$ of 5 inches or about 5 inches and a bottom width $W_1$ of 2.25 inches or about 2.25 inches. In another preferred embodiment, the pad 110 has a top width $W_2$ of 4 inches or about 4 inches and a bottom width $W_3$ of 1.5 inches or about 1.5 inches. Although the embodiment illustrated in FIGS. 2A and 2B includes a third side 134*a* and a fourth side 134*b* that are straight or relatively straight, embodiments of the invention may include a third side 134*a* and a fourth side 134*b* that are concave or contoured for improved fit and comfort of the athlete's legs (e.g., as illustrated in FIGS. 4A and 4B).

Figure 5:
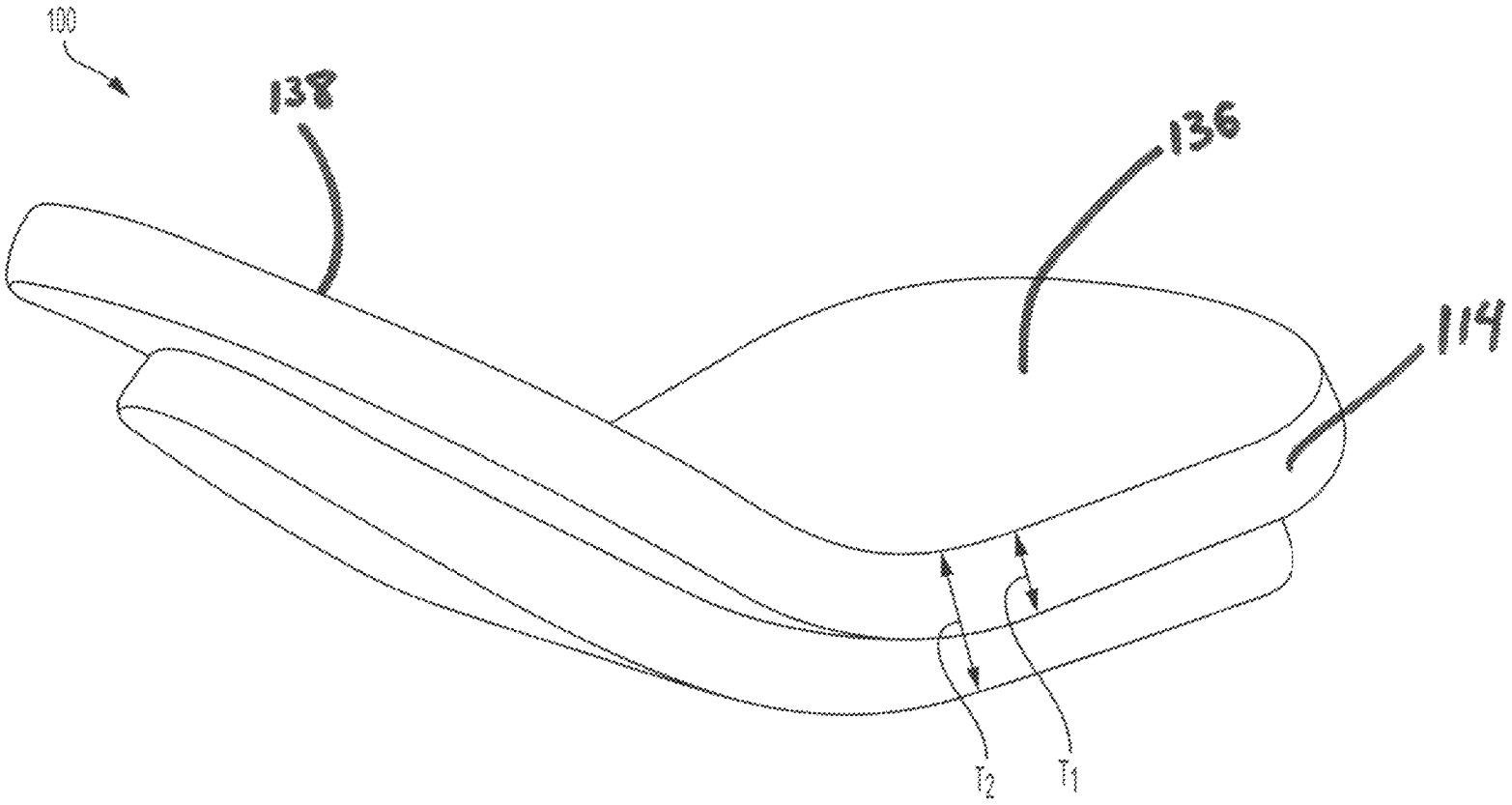
FIG. 5 is a perspective view of a further non-limiting embodiment of an athletic protector.

Edge portion 124 has a thickness $T_1$ that is less than a thickness $T_2$ of central portion 126 of pad 110, as shown in FIG. 5. As mentioned above, edge portion 124 may be formed by less than all the layers of plurality of layers 112. For example, as illustrated in FIGS. 1-26 and 4A-5, edge portion 124 is formed solely of first elastomer layer 114 and has a thickness $T_1$ associated with the thickness of first elastomer layer 114, while central portion 126 is formed from plurality of layers 112 and has a thickness $T_2$ associated with the layers 114, 116, 118, and 120 of plurality of layers 112. Edge portion 124 may be configured to be positioned adjacent to the inguinal area of the athlete's body. By configuring edge portion 124 to have a thickness less than central portion 126 and/or to be formed solely of an elastomer, edge portion 124 may provide superior comfort for the athlete. For example, edge portion 124 may have a thickness $T_1$ that is at least 50% less than the thickness of thickness $T_2$ of central 126 of pad 110. Although edge portion 124 is illustrated in FIGS. 1, 2B, 4B, and 5 as having a uniform thickness $T_1$, in another embodiment the thickness $T_1$ of edge portion 124 tappers toward outer perimeter 130, such that the thickness of edge portion 124 by outer perimeter 130 is less than half the thickness of edge portion 124 by perimeter 127 of central portion 126.

Figure 2B:
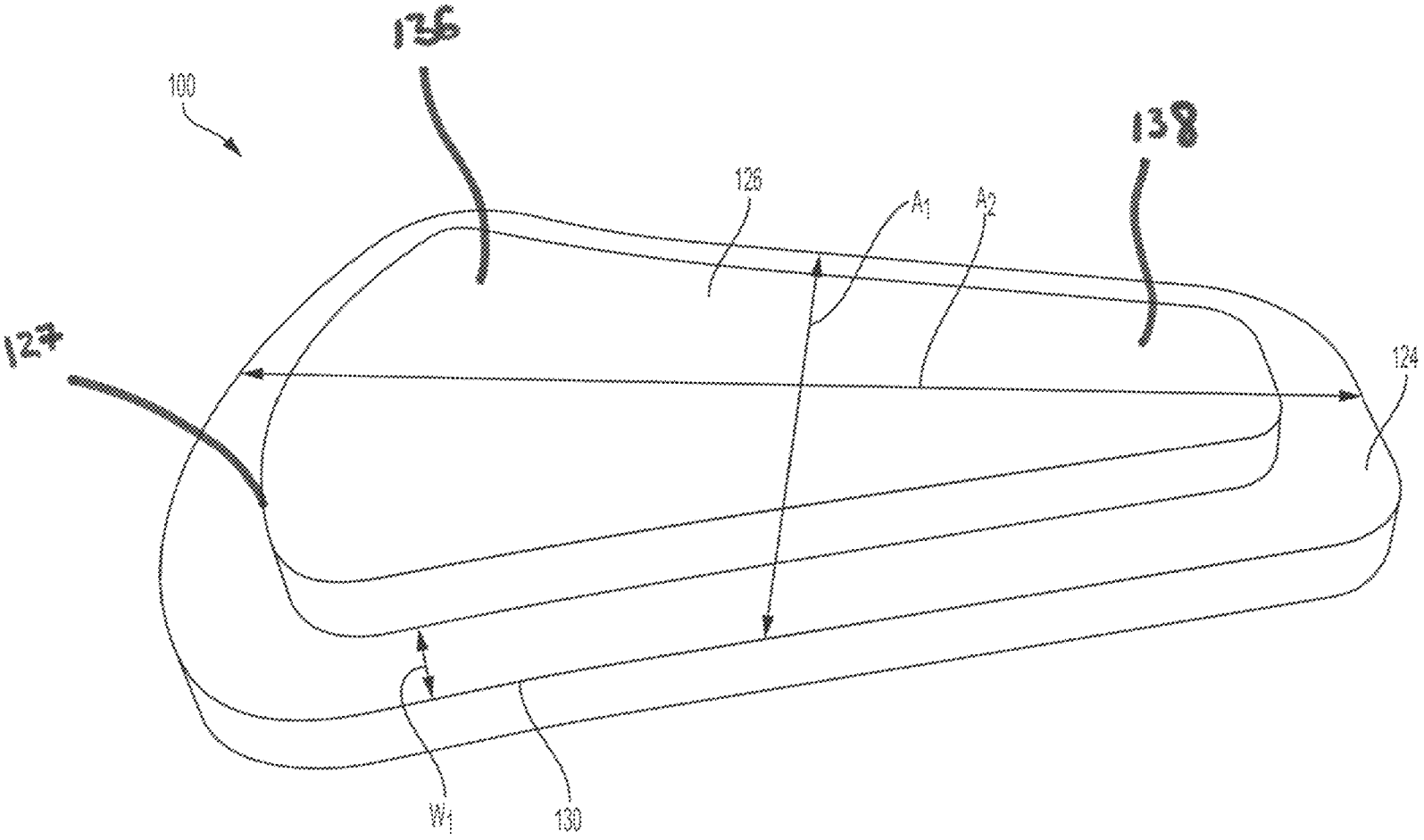
FIG. 2B is a perspective view of the athletic protector of FIG. 2A.
Figure 6:
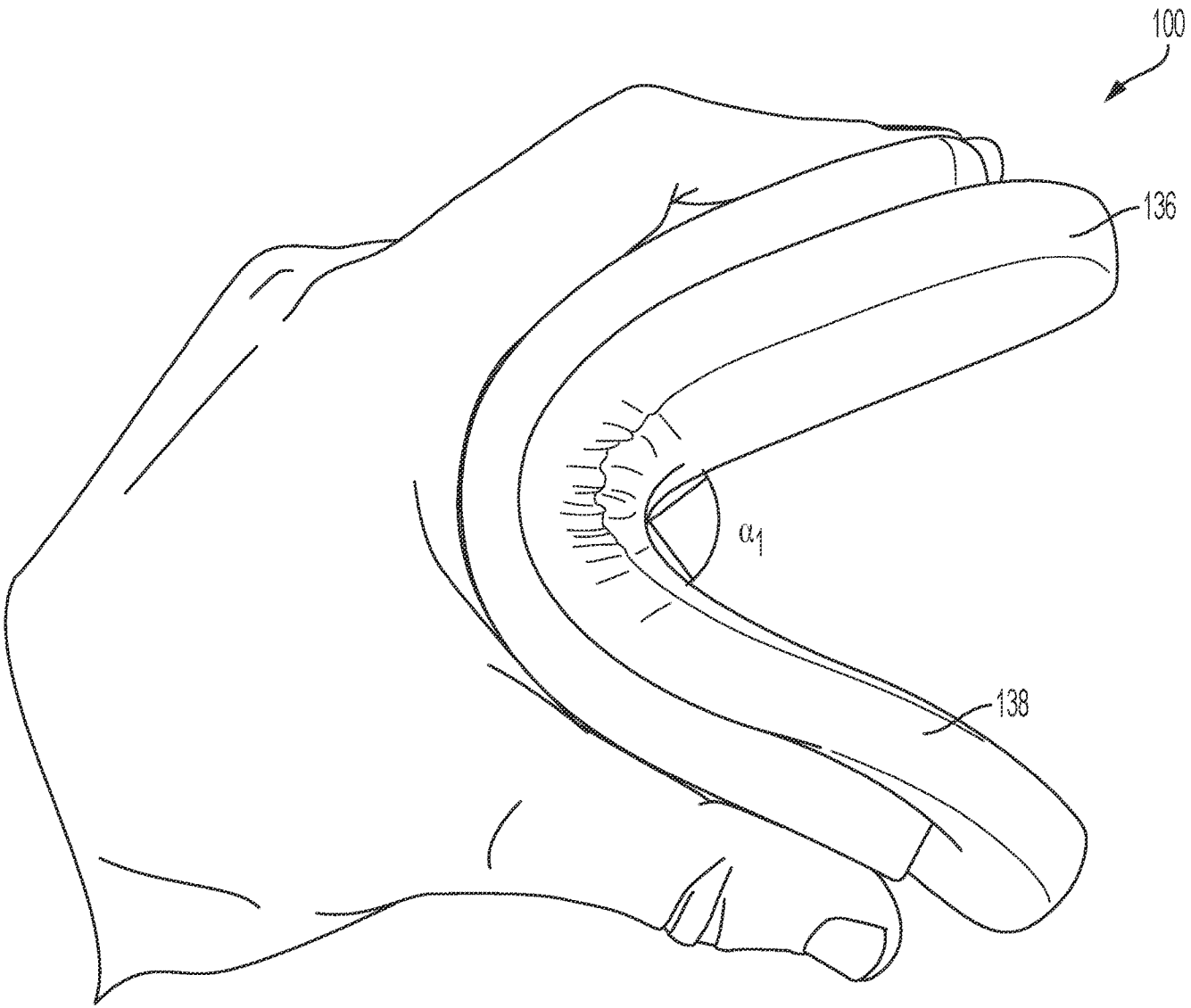
FIG. 6 is a perspective view of the athletic protector of FIG. 5 bent by a user to a desired angle.
Figure 7:
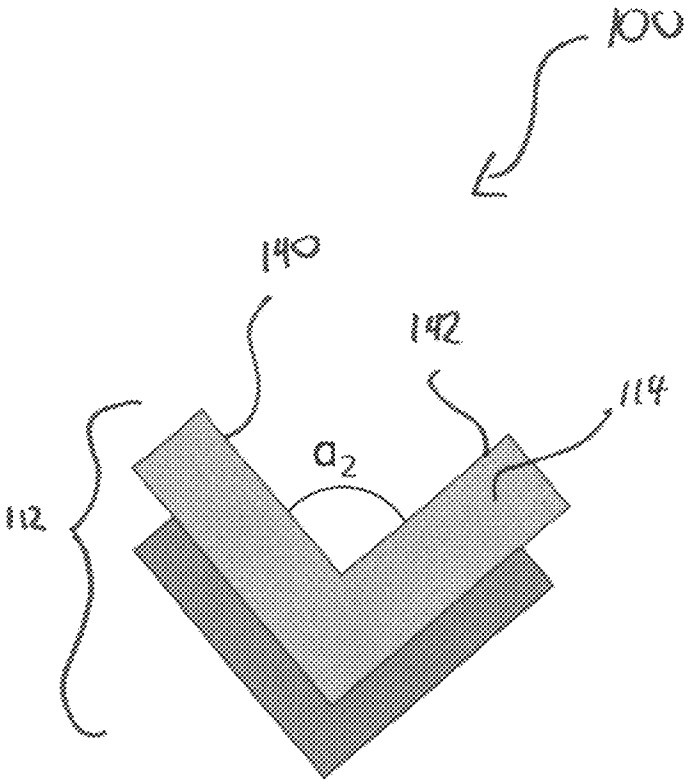
FIG. 7 is a cross-sectional schematic of a non-limiting embodiment of an athletic protector that is bent along the longitudinal axis.

Referring to FIG. 2B, athletic protector 100 may be flexible and/or configured to bend along an axis $A_1$ extending in a central width direction, an axis extending in the width direction across the upper section 136 and/or lower section 138 (e.g., width $W_2$ and/or width $W_1$), or along a central longitudinal axis $A_2$. As illustrated in FIG. 6, athletic protector 100 may bend along axis $A_1$ in the central width direction to form an angle $\alpha_1$ between upper section 136 and lower section 138. For example, at least one of the upper section 136 and/or lower section 138 may bend by at least 20° along axis $A_1$ in the central width direction with respect to its original position. Athletic protector 100 may be configured such that at least one of the upper section 136 and/or lower section 138 bends along axis $A_1$ in the central width direction with respect to its original position by at least 20°, at least 30°, at least 45°, at least 60°, at least 75°, at least 90°, at least 105°, etc. Additionally, athletic protection 100 may be configured to bend along central longitudinal axis $A_2$ to form an angle $\alpha_2$ between a first side 140 (e.g., a left side) of first elastomer layer 114 and second side 142 (e.g., a right side) of first elastomer layer 114, as illustrated in FIG. 7. At least one of first side 140 of first elastomer layer 114 and second side 142 of first elastomer layer 114 may bend along central longitudinal axis $A_2$ to form an angle $\alpha_2$ therebetween of at least 10°, at least 15°, at least 20°, at least 25°, at least 30°, at least 35°, at least 40°, or at least 45°, etc.

Preferably, athletic protector 100 may be sufficiently flexible to allow a user to bend or mold pad 110 to a desired angle or shape of their choice. For example, athletic protector 100 may be configured to bend or be molded to form an angle $\alpha_1$ between upper section 136 and lower section 138 of 170° or less, 165° or less, 150° or less, 135° or less, 120° or less, 105° or less, 90° or less, 75° or less, 60° or less, or 45° or less and/or to form an angle of 30° or more, 45° or more, 60° or more, 75° or more, 90° or more, 105° or more, 120° or more, 135° or more, 150° or more, 165° or more. In one embodiment, upper section 136 and lower section 138 of athletic protector 100 form an angle therebetween of 90° or more and 150° or less. Additionally and/or alternatively, athletic protector may be configured to bend or be molded to form an angle $\alpha_2$ between first side 140 of first elastomer layer 114 and second side 142 of first elastomer layer 114 of 175° or less, 170° or less, 165° or less, 155° or less, 145° or less, 135° or less, 125° or less, 115° or less, 105° or less, or 90° or less and/or to form an angle of 90° or more, 105° or more, 115° or more, 125° or more, 135° or more, 145° or more, 165° or more, 170° or more, or 175° or more.

Athletic protector 100 may be sufficiently rigid to allow pad 110 to remain at the desired angle or shape until rebended or remolded by the user, as shown in FIG. 6. In accordance with one aspect of the invention, athletic protector 100 is configured to be flexible and/or bend, as discussed above, and retain its shape after bending. The polymer layer 120 and/or high-tensile strength layer 118 may be formed of material that retains its shape after bending or molding. The bending or molding may athletic protector 100 have minimal or no effect on the integrity or performance of athletic protector 100. In one embodiment, however, bending athletic protector 100 produces plastic deformation of polymer layer 120 and/or high-tensile strength layer 118, which retains the desired angle or shape after bending.

According to another aspect of the invention, athletic protector 100 is configured to be flexible and/or bend, as discussed above, but athletic protector 100 does not retain its shape after bending. Athletic protector 100 may be formed of materials that enable athletic protector 100 to elastically bend and return to its original shape (e.g., the shape of athletic protector produced during molding of the plurality of layers 112 or one or more of the layers thereof).

In yet a further embodiment, athletic protector is rigid and does not bend. Polymer layer 120 and/or high-tensile strength layer 118 may be rigid, such that athletic protector 100 does not readily bend and/or is rigid.

Figure 3:
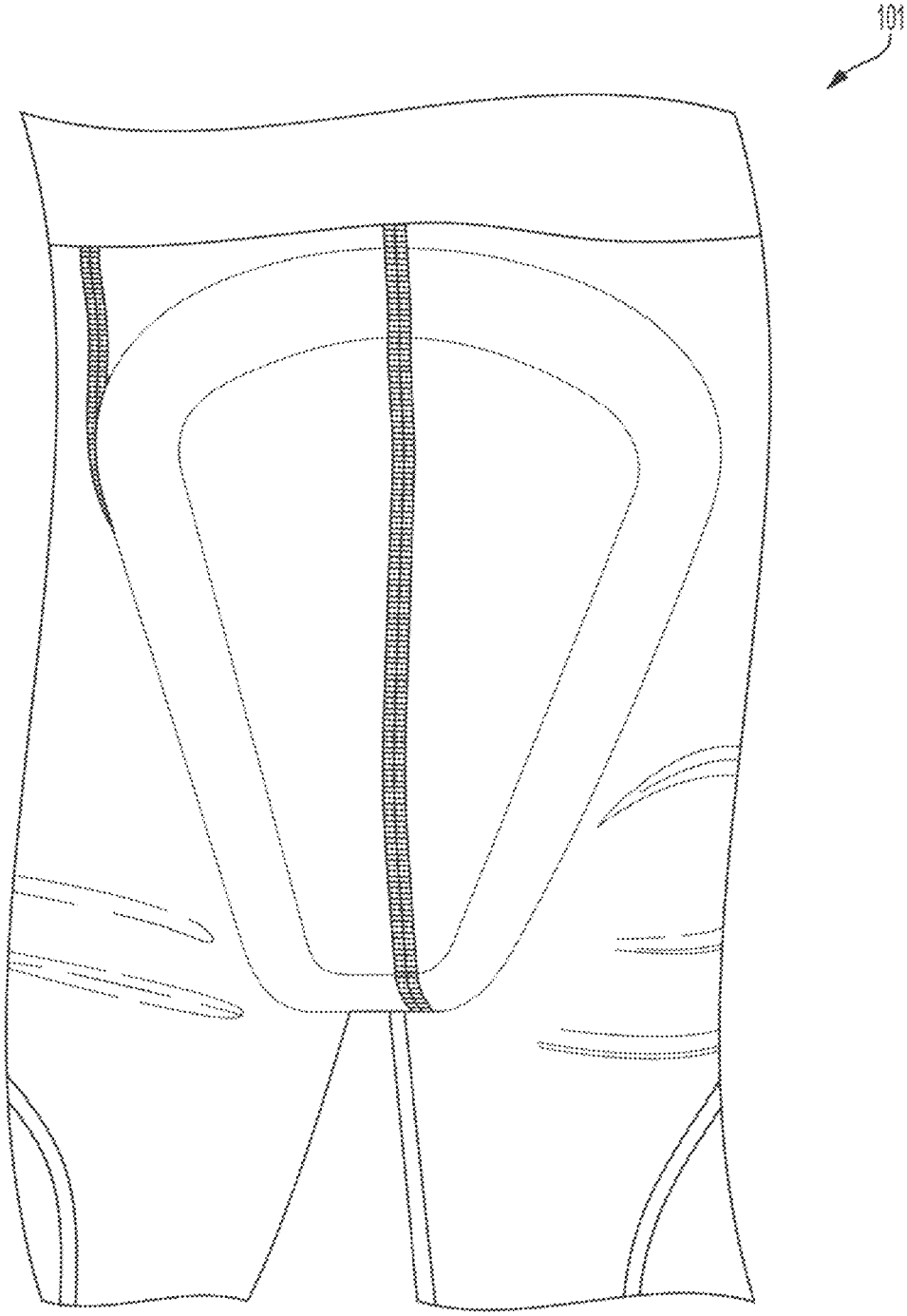
FIG. 3 is an elevation view of the athletic protector of FIG. 2A in a male football girdle.

Additionally and/or alternatively, athletic protector 100 has a first surface 102 that is configured to be flat in an unapplied state and to form a contour in an applied state. As used herein, in the "unapplied state" the athletic protector is not being pressed or coupled to the athlete's body. The "applied state" refers to the athletic protector being coupled to the athlete's body part and/or being pressed against the athlete's body part by a pressure and/or force. Athletic protector 100 may form a contour corresponding to or substantially corresponding to the athlete's body part (e.g., an athlete's genitals) when the athletic protector 100 is pressed against the athlete's body part. For example, positioning athletic protector 100 in a girdle 101, a jock strap, or the like (e.g., as shown in FIG. 3) may press athletic protector 100 against the athlete's genitals, such that athletic protector 100 forms a contour and is in the applied state. In one embodiment, pad 110 is configured to diminish an impact force when the pad is in the applied state. Athletic protector 100 may be configured without a rigid shell and/or a rigid layer. Preferably, athletic protector 100 does not include a rigid shell or rigid layer that is unable to bend at least 20° (e.g., at an axis in the central width direction or a longitudinal axis of the rigid shell and/or rigid layer) without damaging or causing plastic deformation of the rigid shell and/or the rigid layer. In one embodiment, athletic protector 100 is not attached or coupled to a rigid shell and/or rigid layer.

Although the invention is illustrated and described herein with reference to specific embodiments, the invention is not intended to be limited to the details shown. Rather, various, modifications may be made in the details within the scope and range of equivalents of the claims and without departing from the invention. In particular, any of the features described herein with respect to one embodiment may be provided in any of the other embodiments.

What is claimed is:

1. An athletic protector consisting of:

a pad formed from a plurality of layers and configured to be impact-resistant, the pad having a central portion which is delineated along a perimeter thereof by an edge portion, the edge portion extending from the perimeter of the central portion to an outer perimeter and having a thickness that is less than a thickness of the central portion of the pad, wherein the pad is configured to bend into a bent shape forming an angle of at least 30°, wherein the athletic protector is configured to cover an area of an athlete's genitalia and does not include a rigid shell;

wherein the plurality of layers includes at least a first foam layer and a polymer layer, the first foam layer having a first density;

wherein the plurality of layers includes a second foam layer having a second density that is higher than the first density, the second foam layer positioned between the first foam layer and the polymer layer; and wherein the edge portion of the pad includes only the first foam layer of the plurality of layers.

2. The athletic protector of claim 1, wherein the pad has a first side spaced from a second side by a length and a third side spaced from a fourth side at a top portion of the pad by a first width and at a bottom portion of the pad by a second width different from the first width.

3. The athletic protector of claim 2, wherein a ratio of the first width to the second width is in a range of 1.5:1 to 3.5:1.

4. The athletic protector of claim 1, wherein the central portion of the pad includes the plurality of layers, and the edge portion of the pad includes fewer than all of the plurality of layers.

5. The athletic protector of claim 1, wherein the plurality of layers includes a high tensile strength layer positioned between the first foam layer and the polymer layer.

6. The athletic protector of claim 5, wherein the high tensile strength layer and the polymer layer are only disposed in the central portion.

7. The athletic protector of claim 1, wherein the bent shape of the athletic protector includes upper and lower sections which form an angle therebetween of 90° or more and 150° or less.

8. The athletic protector of claim 1, wherein the thickness of the edge portion is 50% or less than the thickness of the central portion.

9. The athletic protector of claim 1, wherein the pad is configured to retain the bent shape after the bending.

10. The athletic protector of claim 1, wherein the plurality of layers includes at least one adhesive layer that adheres the other layers of the plurality of layers together.

* * * * *